US006045383A

United States Patent [19]

Fujiwara

[11] Patent Number: 6,045,383

[45] Date of Patent: Apr. 4, 2000

[54] SEALING MEMBER FOR WATERPROOF CONNECTOR

[75] Inventor: Yoshihito Fujiwara, Komae, Japan

[73] Assignee: The Whitaker Corporation, Wilmington, Del.

[21] Appl. No.: 09/180,625

[22] PCT Filed: May 16, 1997

[86] PCT No.: PCT/US97/08721

§ 371 Date: Nov. 12, 1998

§ 102(e) Date: Nov. 12, 1998

[87] PCT Pub. No.: WO97/43803

PCT Pub. Date: Nov. 20, 1997

[30] Foreign Application Priority Data

May 17, 1996 [JP] Japan ..... 8-171688

[51] Int. Cl.[7] ..... H01R 13/52

[52] U.S. Cl. ..... 439/271; 439/272; 439/273

[58] Field of Search ..... 439/271, 272, 439/273, 274, 275, 587

[56] References Cited

U.S. PATENT DOCUMENTS

| | | | |
|---|---|---|---|
| 4,944,688 | 7/1990 | Lundergan | 439/275 |
| 5,336,101 | 8/1994 | Kasugai et al. | 439/272 |
| 5,492,487 | 2/1996 | Cairns et al. | 439/273 |
| 5,735,702 | 4/1998 | Hio | 439/271 |

FOREIGN PATENT DOCUMENTS

| | | |
|---|---|---|
| 0 691 711 A1 | 1/1996 | European Pat. Off. . |
| 0 736 935 A2 | 10/1996 | European Pat. Off. . |
| 02 014 139 | 4/1990 | Japan . |

*Primary Examiner*—Paula Bradley
*Assistant Examiner*—Tho D. Ta

[57] ABSTRACT

The sealing member (100) for a waterproof connector has three outward-facing projecting rib parts (106) and three inward-facing projecting rib parts (108). The outward-facing projecting rib parts (106*a,* 106*b,* 106*c*) have substantially the same height, and the projecting rib parts (106*a* and 106*c*) on both sides are flexible. The height of the central inward-facing projecting rib part (108*b*) is lower than the height of the inward-facing projecting rib parts (108*a,* 108*c*). The sealing member (100) is mounted on one (male) connector in the area of the inward-facing projecting rib parts (108). This sealing member (100) contacts the other (female) connector (50) in the area of the outward-facing projecting rib parts (106); in this case, the central projecting rib parts 106*b,* 108*b*) are displaced downward, and the outward-facing projecting rib parts (106*a,* 106*c*) are inclined inward.

5 Claims, 5 Drawing Sheets

SEALING MEMBER FOR WATERPROOF CONNECTOR

BACKGROUND OF THE INVENTION

The present invention is related to a sealing member, and specifically, a sealing member for a waterproof connector which seals connectors to each other.

Connectors housings are ordinarily waterproofed (sealed to each other) via sealing members. For example, the waterproof connector sealing member (hereafter referred to simply as a "sealing member") is disclosed in Japanese Utility Model Publication No. 2-14139. This sealing member is a frame-form body consisting of an elastic material such as rubber or the like, and has three projecting ridge parts formed on its outside surface, and three projecting ridge parts formed on its inside surface. The projecting ridge parts on the inside surface cover one housing, while the projecting ridge parts on the outside surface are in rubbing contact with another connector housing, so that a seal is formed. The projecting ridge part on the outside surface is formed so that it is thinner than the projecting ridge parts; furthermore, the height of this projecting ridge part is greater than the height of the projecting ridge parts in the shoulder portions of the frame-form body. In this way, deformation of the sealing member due to shrinkage following molding is prevented, so that the sealing characteristics are improved.

In the prior art described above, waterproofing is accomplished by compressive deformation of the projecting ridge parts. However, unless the pressing force used to cause this compressive deformation is large, there is no effect; furthermore, the amount of deformation is small, and gaps tend to be generated. Accordingly, the force required in order to engage the housings with each other is large; furthermore, the sealing member cannot follow variations in the dimensions of the housings or deformation of the housings caused by heat, and therefore allows water to enter.

SUMMARY OF THE INVENTION

The present invention was devised in light of the above points. The object of the present invention is to provide a sealing member for a waterproof connector in which the force required in order to engage the housings is small, and in which waterproof characteristics can be maintained even in the case of variation in the dimensions of the housings or deformation of the housings.

The invention is directed to a sealing member for a connector comprising at least three outward facing projecting ribs and at least three inward facing projecting ribs. The inward facing projecting ribs are received against a sealing surface of the connector. The outward facing projecting ribs form a seal by making elastic rubbing contact with a second sealing surface of another connector. The outer most outward facing projecting ribs are flexible. The height of the inner inward facing projecting rib being lower than the height of the outer inward facing projecting ribs.

BRIEF DESCRIPTION OF THE DRAWINGS

Embodiments of the present invention will now be described with reference to the accompanying drawings, in which.

DETAILED DESCRIPTION OF THE PREFERRED EMBODIMENT

Figure 1:
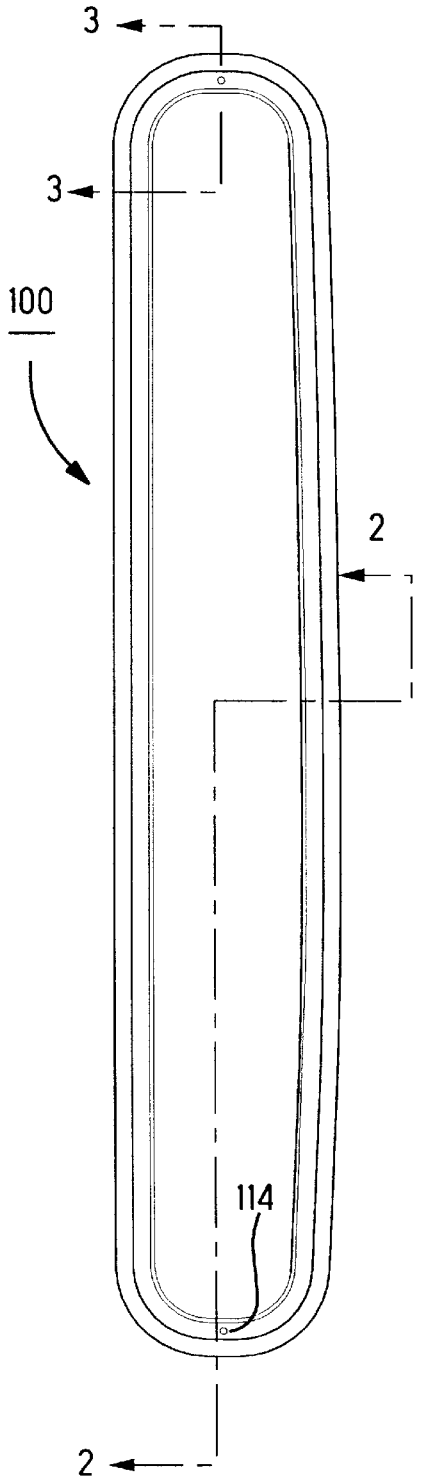
FIG. 1 illustrates a front view of the sealing member for a waterproof connector provided by the present invention.

Below, the sealing member for a waterproof connector (hereafter referred to simply as a "sealing member") 100 provided by the present invention will be described in detail with reference to the attached figures. FIG. 1 illustrates the sealing member 100 of the present invention. The sealing member 100 is formed from an elastic material such as rubber or the like, and has a long, slender substantially frame-form shape as shown in FIG. 1. Outward-facing projecting rib parts 106*a,* 106*b* and 106*c* which run in the outer circumferential direction are formed on the outside surface 102 of the web 110, see FIG. 3 of the sealing member 100, and inward-facing projecting ribs 108*a,* 108*b* and 108*c* which run in the inner circumferential direction are formed on the inside surface 104 of the web 110 of the sealing member 100. The respective projecting rib parts 106*a,* 106*b,* 106*c* and 108*a,* 108*b,* 108*c* are collectively indicated by the numbers 106 and 108. The inward-facing projecting rib parts 108 are attached to an inside housing 6; the details of this attachment are illustrated in FIG. 4.

Figure 2:
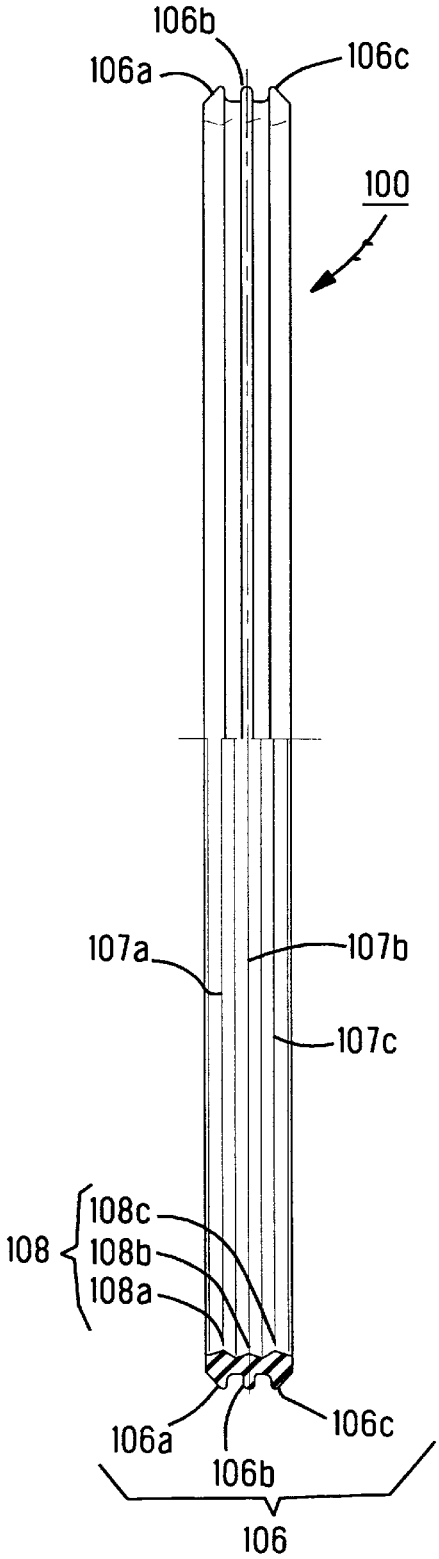
FIG. 2 is a partial sectional side view along line 2—2 in FIG. 1.
Figure 3:
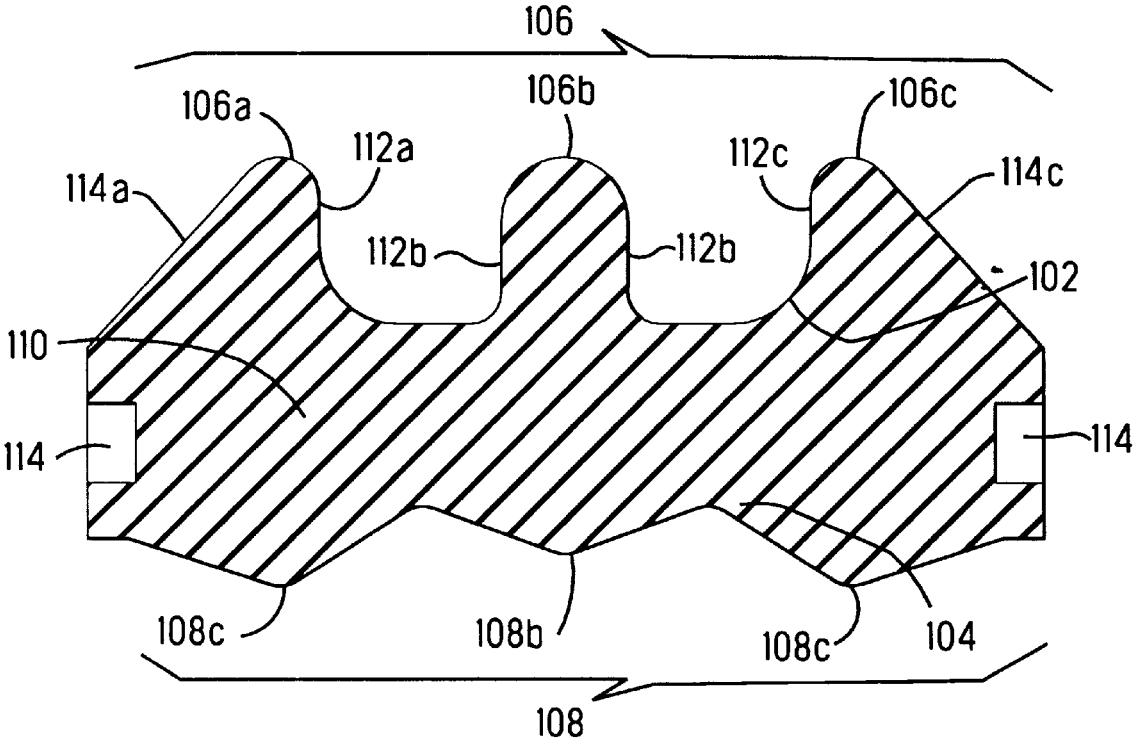
FIG. 3 is an enlarged sectional view along line 3—3 in FIG. 1.

Next, as is shown in FIG. 3, the three outward-facing projecting rib parts 106*a,* 106*b* and 106*c* have substantially the same height around the entire circumference of the sealing member 100, and respective perpendicular surfaces 112*a,* 112*c* and inclined surfaces 114*a,* 114*c* are formed on the outward-facing projecting rib parts 106*a* and 106*c* located on both sides of the sealing member 100. The outward-facing projecting rib part 106*b* positioned in the approximate center to the inside of the outward-facing projecting rib parts 106*a* and 106*b* has perpendicular surfaces 112*b,* 112*b* on both sides, and extends perpendicularly from the web 110. The tips of the respective outward-facing projecting rib parts 106*a,* 106*b* and 106*c* have curved shapes. Meanwhile, on the inside surface 104, inward-facing projecting rib parts 108*a,* 108*b* and 108*c* are formed in positions corresponding to the positions of the outward-facing projecting rib parts 106*a,* 106*b* and 106*c*. The inward-facing projecting rib parts 108*a* and 108*c* have substantially the same height; however, the height of the inward-facing projecting rib part 108*b* formed to the inside of the inward-facing projecting rib parts 108*a* and 108*c* located on both sides i.e., the projecting rib part 108*b* formed in the approximate center in the present embodiment, is lower than the height of the inward-facing projecting rib parts 108*a* and 108*c* on both sides around the entire circumference of the sealing member 100. It is desirable that the tips of the respective inward-facing projecting rib parts 108*a,* 108*b* and 108*c* be substantially linear as indicated by lines 107*a,* 107*b* and 107*c* in FIG. 2. Furthermore, the recesses indicated by 114 in the figures are marks used for positioning by the worker when the sealing member 100 is installed on the inside housing 6 (FIG. 4).

Figure 4:
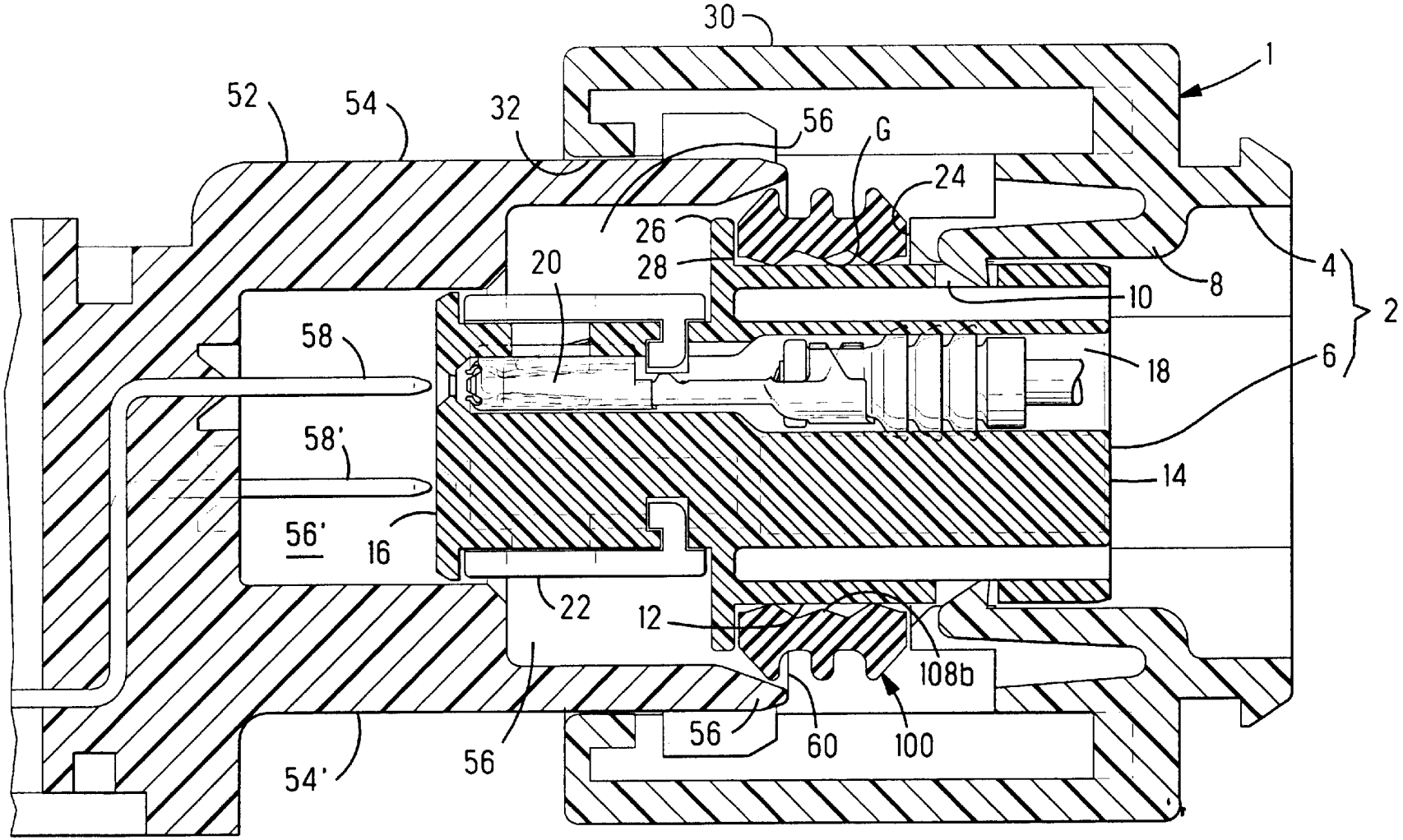
FIG. 4 shows a sectional view of the sealing member of the present invention installed on a male connector, along with a female connector.

In FIG. 4, a sectional view of the sealing member 100 of the present invention installed on a male connector 1 is shown along with a female connector 50. In the present embodiment, the connector housing 2 of the male connector 1 is constructed from an outside housing 4 and an inside housing 6 which extend in the direction perpendicular to the plane of the page. Respective latch arms 8 and engaging holes 10 are installed in the outside housing 4 and inside housing 6, and the respective housings are fastened to each other by latch engagement. The sealing member 100 is mounted on the carrying surface 12 of the inside housing 6. The inside housing 6 has a plurality of terminal accommodating passages 18 which extend from the rear end surface 14 of the housing 6 to the front end surface 16; terminals 20 are positioned inside these terminal accommodating passages 18. In the figures, 22 indicates secondary anchoring members which are used in order to insure secure attachment of the terminals 20. Movement of the sealing member 100 in the forward-rearward direction is restricted by a contact surface 24 facing toward the front of the outside housing 4, and a rearward-facing retaining surface 28 formed on a flange 26 which is formed on the inside housing 6. It is clearly shown in the figures that a gap G is formed between the inward-facing projecting rib part 108*b* and the carrying surface 12.

The connector housing, hereafter referred to simply as a "housing", 52 of the female connector 50 is equipped with terminals 58, 58', side walls 54, 54' and recesses 56, 56' (formed in the side walls) which accommodate the inside housing 6. As is shown in the figures, the front portions of the side walls 54, 54' are inserted into openings 32 formed in the hood 30 of the outside housing 4, so that the front end portions 56 of the side walls 54, 54' are positioned in positions located just prior to the point of contact with the sealing member 100. Next, the state of contact between the side walls 54, 54' and the sealing member 100 will be described referring to FIGS. 5 through 7 in order. Furthermore, since end walls 60 (only one of which is shown in the figures) which substantially intersect with the side walls 54, 54' are also constructed in a similar relationship with the side walls 54, 54' (with respect to the sealing member 100), only the side wall 54 will be described here.

Figure 5:
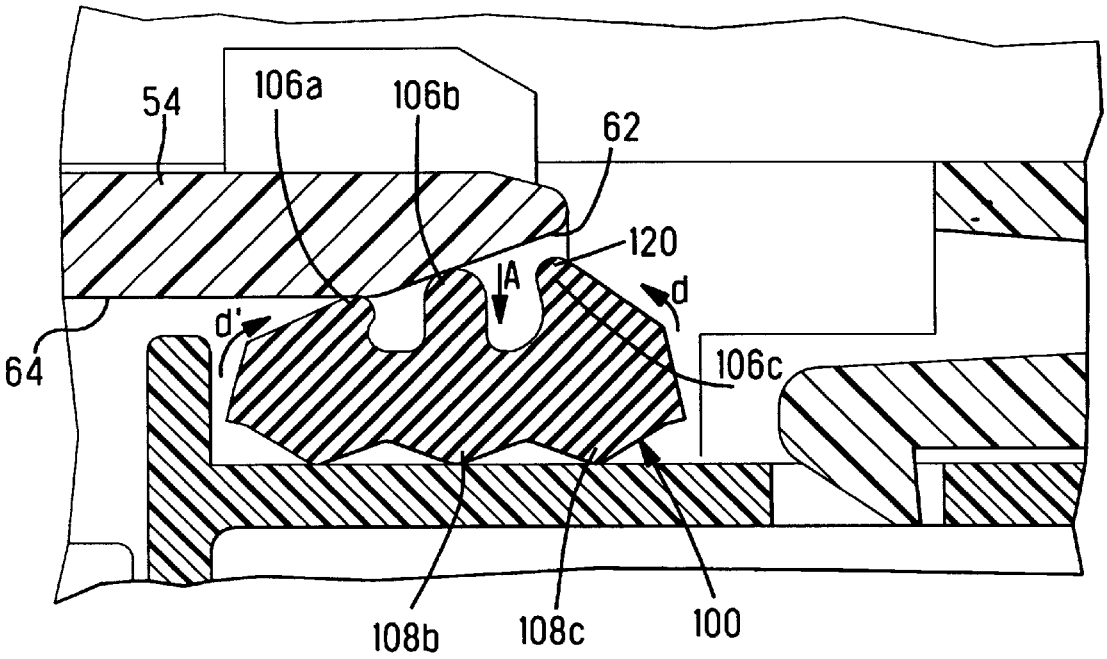
FIG. 5 is a partial enlarged sectional view which shows the initial position in which the side wall contacts the sealing member.
Figure 6:
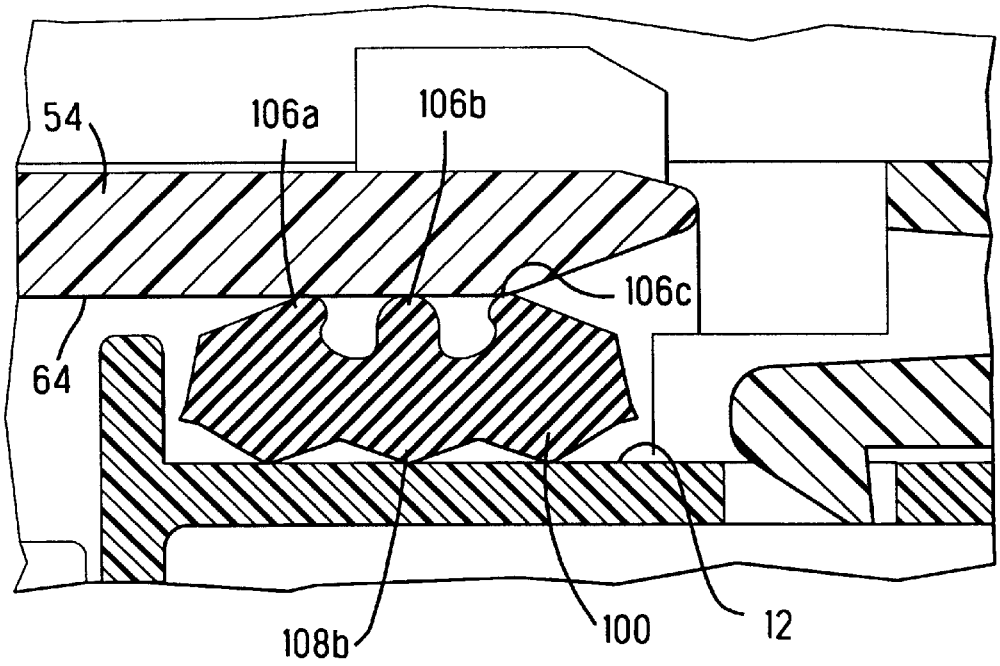
FIG. 6 is a partial enlarged sectional view similar to FIG. 5, which shows a state in which the side wall has been further inserted.
Figure 7:
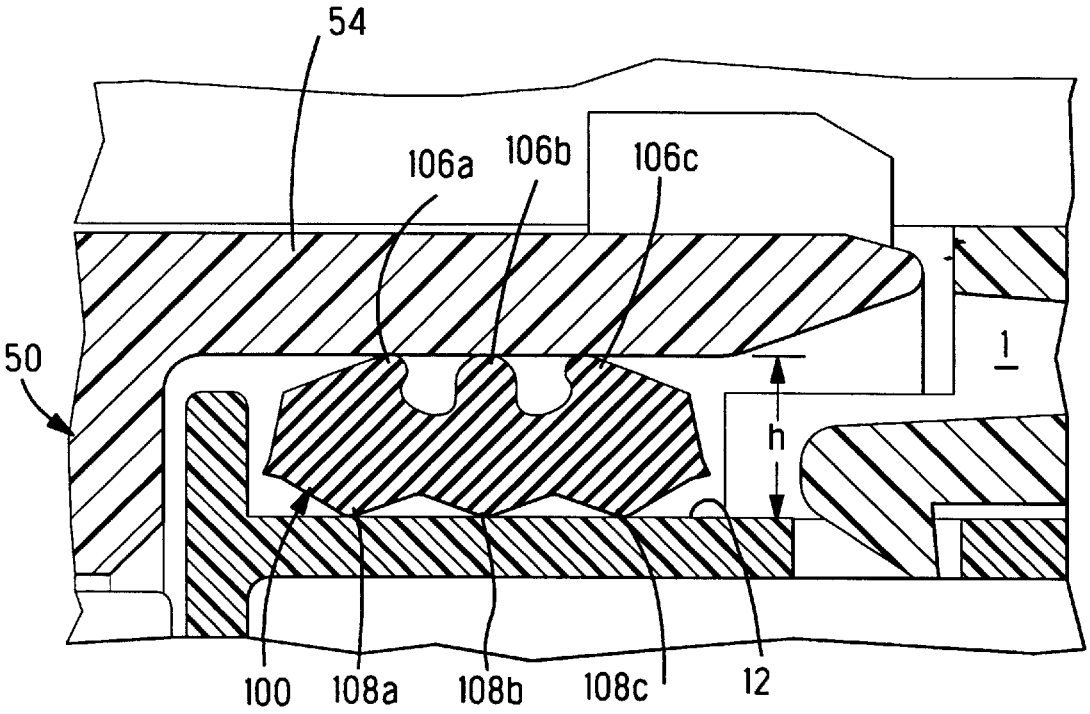
FIG. 7 is a partial enlarged sectional view similar to FIG. 5, which shows a state in which the connectors are completely engaged with each other.

FIGS. 5 through 7 are partial enlarged sectional views which show in order the transition from a state in which the sealing member 100 and side wall 54 initially make contact to a state in which the connectors are completely engaged with each other. A tapered surface 62 is formed on the undersurface 64 of the side wall 54, and this undersurface 64 and tapered surface 62 press against the outward-facing projecting rib parts 106*a* and 106*b*. Since the outward-facing projecting rib part 106*a* is flexible, this outward-facing projecting rib part 106*a* bends in the direction of advance of the side wall 54; furthermore, the outward-facing projecting rib part 106*b* is pressed in the direction indicated by arrow A, i.e., a direction perpendicular to the direction of insertion of the connector. As the outward-facing projecting rib part 106*b* is pressed in the direction indicated by arrow A, the inward-facing projecting rib part 108*b* which is located in a corresponding position also moves in the direction indicated by arrow A so that the gap G is blocked. Furthermore, as a result of these central projecting rib parts 106*b* and 108*b* moving downward (with respect to the figures), a rotational moment indicated by arrow d is generated about the inward-facing projecting rib part 108*c*, so that the tip portion 120 of the outward-facing projecting rib part 106*c* begins to incline toward the inside, i.e., toward the central outward-facing projecting rib part 106*b*. In the case of the outward-facing projecting rib part 106*a*, the rotational moment indicated by arrow d' causes the outward-facing projecting rib part 106*a* to incline even further.

FIG. 6 shows a state in which the side wall 54 has been inserted even further, so that the undersurface 64 of the side wall 54 has contacted all of the outward-facing projecting rib parts 106*a*, 106*b* and 106*c*. Here, the central outward-facing projecting rib part 106*b* compressed further downward by the undersurface 64, and the outward-facing projecting rib part 106*c* is similarly pressed downward while contacting the undersurface 64 in an even more inclined state. In this case, the respective tip ends of the inward-facing projecting rib parts 108 are pressed against the carrying surface 12, and are tightly sealed with the carrying surface 12 by small-area contact surfaces.

FIG. 7 shows a state in which the side wall shown in FIG. 6 has been inserted even further so that the connectors are completely engaged with each other. In this state, a waterproof seal between the female connector 50 and the male connector 1 is formed by the side wall 54 and the carrying surface 12 of the inside housing 6. This waterproof seal is formed mainly by the central outward-facing and inward-facing projecting rib parts 106*b* and 108*b*; the adjacent outward-facing projecting rib parts 106*a* and 106*c* and inward-facing projecting rib parts 108*a* and 108*c* act to reinforce this waterproofing function. Since the outward-facing projecting rib parts 106*a* and 106*c* are flexible, the side wall 54 can be inserted using a relatively small engaging force. Furthermore, even if there should be some variation in the dimensions of the housing 52 or inside housing 6, or if the gap h between the side wall 54 and the carrying surface 12 should deviate from the prescribed dimension due to thermal deformation, the outward-facing projecting rib parts 106*a* and 106*c* can conform to such deviations so that there is no loss of waterproofing function.

Figure 8:
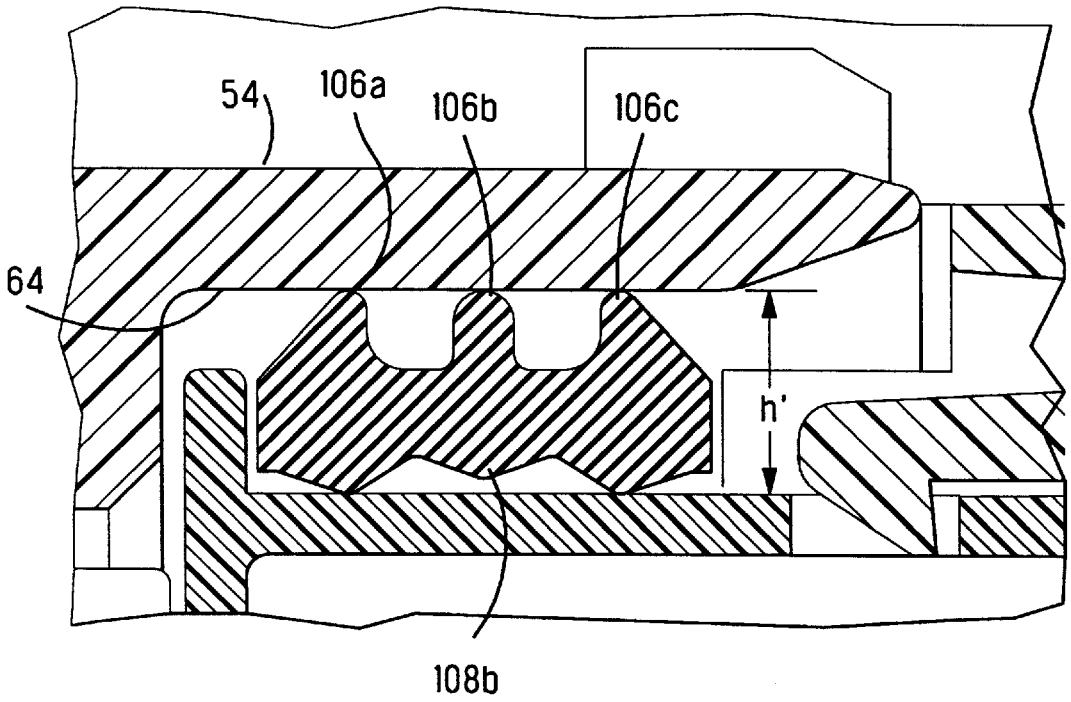
FIG. 8 is a partial enlarged sectional view similar to FIG. 5, which shows the state of the seal in a case where the gap in the seal area is large.

For example, even in a case where the gap h is enlarged to form a gap h', as shown in FIG. 8, the vertical displacement of the central outward-facing projecting rib part 106*b* is large, and the outward-facing projecting rib parts 106*a* and 106*c* tend to bend because of their flexibility, and are caused to rise outward by this elastic force; accordingly, there is no separation from the undersurface 64 of the side wall 54, and the waterproofing function can be maintained. Accordingly, in the case of a gap h which is the same as in a conventional device, high sealing properties with a sufficient margin can be obtained. Furthermore, since the outward-facing projecting rib parts 106*a* and 106*c* are inclined inward toward each other, even if water should somehow enter from one side and pass around the central outward-facing projecting rib part 106*b*, it is difficult for this water to pass beyond the other outward-facing projecting rib part on the opposite side. Specifically, in cases where water pressure is applied to this other outward-facing projecting rib part from the inside, a force which presses the outward-facing projecting rib part against the side wall 54 acts so that even stronger contact is maintained between the outward-facing projecting rib part and the side wall 54, thus making it difficult for water to pass through. Accordingly, even in cases where the insertion opening is large, a connector can be built in which the thickness of the sealing member is small.

The sealing member for a waterproof connector provided by the present invention was described in detail above. However, the present invention is not limited to this embodiment; it goes without saying that various modifications and alterations are possible. For example, the central outward-facing projecting rib part 106*b* may also have a degree of flexibility which makes it possible to press the central inward-facing projecting rib part 108*b* against the carrying surface 12. Furthermore, the tip ends of the inward-facing projecting rib parts 108 may also be curved. In addition, since the sealing member 100 is symmetrical, as shown in FIG. 2, this sealing member 100 may be mounted from either the left or right.

The outward-facing projecting rib parts of the sealing member for a waterproof connector provided by the present invention have substantially the same height, and at least the outward-facing projecting rib parts on both sides are flexible. Furthermore, the height of the inner inward-facing projecting rib part is lower than the height of the inward-facing projecting rib parts on both sides. As a result, the sealing member of the present invention possesses the following merits:

Specifically, when the connectors are engaged with each other, the resistance from the sealing member is small; accordingly, connectors in which the required engaging force is correspondingly small can be obtained. Furthermore, a considerable function which compensates for deformation and dimensional error in the connector housings is provided so that good waterproof performance can always be maintained. In addition, a connector with a high heat resistance can be obtained. Moreover, even in cases where the gap in the sealing area between relative large connectors with numerous poles is the same as in a conventional device, waterproof performance with a sufficient margin can be obtained. The present invention possesses these and other conspicuous merits.

I claim:

1. A sealing member (100) for a connector, the sealing member (100) being formed from an elastic material and comprising at least three outward facing projecting ribs (106*a,* 106*b,* 106*c*) and at least three inward facing projecting ribs (108*a,* 108*b,* 108*c*) the inward facing projecting ribs (108*a,* 108*b,* 108*c*) being received against a first sealing surface of the connector, the outward facing projecting ribs (106*a,* 106*b,* 106*c*) form a seal by making elastic rubbing contact with a second sealing surface of a mating connector, two outer most outward facing projecting ribs (106*a,* 106*c*) being flexible, characterized in that the height of an inner inward facing projecting rib (108*b*) being lower than the height of two outer inward facing projecting ribs (108*a,* 108*c*), and the two outer most inward facing ribs (108*a,* 108*c*) being configured to rotate away from the inner inward facing projecting rib (108*b*) and in a direction toward the second sealing surface when the connector is mated with the mating connector to urge the inner inward facing projecting rib (108*b*) against the first sealing surface.

2. The sealing member of claim 1, wherein the sealing member comprises a frame form shape which was received about the periphery of the sealing surface of the connector.

3. The sealing member of claim 1, wherein the inward facing projecting ribs (108*a,* 108*b,* 108*c*), are substantially aligned with the outward facing projecting ribs (106*a,* 106*b,* 106*c*).

4. The sealing member of claim 1, wherein the at least three outward facing projecting ribs (106*a,* 106*b,* 106*c*) have substantially the same height.

5. The sealing member of claim 4, wherein the two outer most outward facing projecting ribs (106*a,* 106*c*), have incline surfaces (114*a,* 114*c*), the incline surfaces being directed towards an inner outward facing projecting rib (106*b*).

* * * * *